US005609656A

United States Patent [19]

Hanson

[11] Patent Number: 5,609,656

[45] Date of Patent: Mar. 11, 1997

[54] PLANT FIBER GRAIN-SPACER FOR ABRASIVE BONDS

[75] Inventor: David B. Hanson, Afton, Wis.

[73] Assignee: Western Atlas, Incorporated, Beloit, Ill.

[21] Appl. No.: 682,294

[22] Filed: Jul. 17, 1996

[51] Int. Cl.[6] ..... B24D 3/02

[52] U.S. Cl. ..... 51/298; 106/686; 106/687; 501/109; 51/307

[58] Field of Search ..... 51/298, 307; 106/686, 106/687; 501/109

[56] References Cited

U.S. PATENT DOCUMENTS

| | | | |
|---|---|---|---|
| 105,320 | 7/1870 | Eaton . | |
| 305,139 | 9/1884 | Boynton et al. . | |
| 426,994 | 4/1890 | Halsey . | |
| 576,370 | 2/1897 | Lorch . | |
| 608,877 | 8/1898 | Lattimore . | |
| 711,762 | 10/1902 | Forster . | |
| 898,381 | 9/1908 | Mattison . | |
| 1,463,611 | 7/1923 | Clapp . | |
| 1,668,475 | 5/1928 | Wescott . | |
| 2,231,123 | 2/1941 | Hubbell . | |
| 4,339,362 | 7/1982 | Pascau . | |
| 4,363,667 | 12/1982 | Birchall et al. . | |
| 5,019,564 | 5/1991 | Lowe et al. . | |
| 5,436,045 | 7/1995 | Fruitman | 428/36.1 |
| 5,460,635 | 10/1995 | Koch et al. | 51/307 |
| 5,498,268 | 3/1996 | Gagliardi et al. | 51/298 |

*Primary Examiner*—Deborah Jones
*Attorney, Agent, or Firm*—Hoffman, Wasson & Gitler

[57] ABSTRACT

A grain-spacer for an abrasive bond containing abrasive grain comprising particles of interlocked and bonded plant fibers.

13 Claims, No Drawings

PLANT FIBER GRAIN-SPACER FOR ABRASIVE BONDS

BACKGROUND OF THE INVENTION

This invention relates to an abrasive bond having improved physical properties.

1. Field of Art

The abrading material of the invention comprises a binder and abrasive grain as known in the art, improved by the addition of compressible plant-fiber particulate. This particulate is useful as a grain-spacer in both resin-bonded and cement-bonded abrasives, provides resilience and strength to normally very brittle cement bonds such as magnesium oxychloride bonds, is relatively inexpensive, and is environmentally sound.

2. Discussion of Related Art

Grain-spacers are commonly used in abrasive bonds to improve physical properties of the bond, depending upon the spacer employed. Cement bonds, especially, tend to suffer from expansion and contraction in the course of use, and various materials, notably cork, have been used to improve bond resiliency.

U.S. Pat. No. 426,994 discloses such an abrasive tool composition comprising a rubber binder, abrasive grit, and cork granules which provide a grinding and polishing wheel "having sufficient softness to hold the abrading particles and sufficient elasticity to yield and act kindly . . . , on the surfaces to be treated combined with the required firmness and strength". U.S. Pat. No. 898,381 to *Matrison* describes a "cork concrete" flooring material comprising cork particles lightly bound with a magnesium oxychloride cement which is "very elastic and springy". U.S. Pat. No. 2,231,123 refers to magnesium oxychloride flooring compositions containing cork which "are highly resilient but their strength has been reduced to the point where they cannot give satisfactory performance".

U.S. Pat. Nos. 1,668,475 to Wescott and 608,877 to *Lattimore* describe abrasive bonds reinforced with plant-derived fibers. U.S. Pat. No. 2,231,123, however, describes at length the difficulties of forming a strong, resilient cementitious bond with such fibers. As stated by the patentee, plant fibers previously proposed for imparting resiliency to magnesium oxychloride cement bonds have, for example, been found to be unstable in the cementitious composition, or difficult to incorporate. Other fibers either imparted little resiliency, or seriously detracted from the soundness and strength of the bond. Wood fibers in particular are stated to "very appreciably [reduce] the water-resistance and strength and soundness of the cementitious compositions . . . ". The patentee speculates that the tensile strength of cementitious bonds containing plant fibers depends to an appreciable extent upon the ability of the individual fibers to move on each other and distribute strain, and addresses these problems by using reclaimed cotton tire cords in a magnesium oxychloride cement composition preferably containing copper powder and silica. The tensile strength of comparison compositions containing cork granules instead of tire cord fibers were substantially weaker.

SUMMARY OF THE DISCLOSURE

The invention provides an abrasive bond comprising a binder, abrasive grit, and a particulate grain-spacer prepared from a fibrous plant material. The invention further provides an abrasive tool such as a grinding wheel comprising this bond.

DETAILED DESCRIPTION OF THE INVENTION

The abrasive bonds of the invention are based on materials known in the art. The binder may be any resin or cement commonly used in polishing and grinding abrasive bonds such as a phenolic, shellac, or epoxy resin, or magnesium oxychloride cement. The abrasive grit may be any useful abrasive grain, such as aluminum oxide or silicon carbide, of the type customarily incorporated into abrasive bonds for abrasive tools.

The grain-spacer useful in the practice of the invention comprises particles of interlocked plant fibers, optionally including mineral filler to increase density of the particles. The particles are conveniently prepared by dewatering an aqueous slurry of the selected fibers, comminuting the dewatered fibers, and agglomerating the comminuted fibers with or without mineral filler as by agitation in an agglomerating device such as a conventional pelletizer or granulator to interlock and bond the fibers and form particles thereof. The particles are then dried. Particles derived from paper sludge are particularly contemplated. In a particular embodiment of the invention, the particles are prepared by the methods described in U.S. Pat. No. 5,019,564, issued May 28, 1991 to *Lowe et al*, incorporated herein by reference. Particles suitable for use in the practice of the invention are also commercially available, for example from Edward Lowe Ind. Inc. of South Bend, Ind. under the trademark BIODAC.

For the purposes of the present invention, the comminuted plant fibers to be agglomerated are preferably about 1–10 mm in length. A final (dried) particle size of about 12–48 mesh U.S. Standard, preferably about 20–40 mesh U.S. Standard is preferred for use in the present invention. Mineral filler may be present in an amount up to about a 90/10 ratio of filler to fiber; however, it is preferred that mineral filler be present in an amount of no more than about a 50/50 ratio of filler to fiber. The grain-spacer is incorporated into the uncured binder with the abrasive grain and any other additives. The fiber-based grain-spacer is suitably incorporated into the curable bond composition in an amount of from about 1.0–60.0% wt. of the composition, based on the desired properties and type of curable bond used. The binder is then cured in the usual manner. Amounts of about 1–2% in cement, 2–60% in epoxy, 2–20% in phenolics (all weight %) are exemplary.

The following Examples illustrate the practice of the invention:

EXAMPLE 1

BIODAC IN MAGNESIUM OXYCHLORIDE BONDED ABRASIVES

A curable magnesium oxychloride cementitious composition comprising the following ingredients was prepared by admixing:

| % WT | |
|---|---|
| 77.0 | ABRASIVE GRAIN (ALUMINUM OXIDE, SILICON CARBIDE) |
| 11.5 | MAGNESIUM OXIDE |
| 10.5 | MAGNESIUM CHLORIDE SOLUTION |

1.0% BIODAC by weight of the composition (2% by volume) was added to one portion of this formulation (2% V/V addition). 1.0% BIODAC by weight of the composition (2% by volume) was substituted for an equal amount by volume of grain in another formulation (2% V/V substit). A third portion of this formulation without BIODAC was used as a control. Physical properties of these formulations reflecting the effectiveness of BIODAC as an expansion/contraction controlling agent and grain replacement were evaluated (Table 1).

TABLE 1

| | CON-TROL | 2% V/V SUBSTIT | 2% V/V ADDITION |
|---|---|---|---|
| FLEXURAL STRENGTH (psi) | 3004 | 2478 | 3326 |
| ELASTIC MODULUS (KN/sqmm) | 77.1 | 70.9 | 69.1 |
| DENSITY (g/cc) | 2.77 | 2.72 | 2.73 |

The above data indicated that a 2% V/V addition is superior to a 2% V/V substitution as a method for incorporating BIODAC into magnesium oxychloride bonded abrasives. This method produces less rigid abrasives without sacrificing strength which would help to control cracking due to heat in dry grinding applications.

EXAMPLE 2

BIODAC IN EPOXY RESIN BONDED ABRASIVES FOR POLISHING APPLICATIONS

A curable epoxy resin composition comprising the following ingredients was prepared by admixing:

| % WT | |
|---|---|
| 24.7 | ABRASIVE GRAIN (ALUMINUM OXIDE, SILICON CARBIDE) |
| 17.8 | EPOXY RESIN (LIQUID) |
| 3.1 | EPOXY CURING AGENT (LIQUID) |
| 54.4 | BIODAC |

A second curable epoxy resin composition of the same formulation except substituting cork for BIODAC on a V/V basis was similarly prepared. The physical properties of these compositions, utilizing BIODAC as a polishing agent, versus that same composition using cork (at the same volume) for the same function were evaluated. The results are set forth in Table 2.

TABLE 2

| | BIODAC | CORK |
|---|---|---|
| FLEXURAL STRENGTH (psi) | 2456 | 517 |
| ELASTIC MODULUS (KN/sqmm) | 3.75 | 0.33 |
| DENSITY (g/cc) | 1.34 | 0.676 |

The data above clearly show that greater strengths and higher densities are achieved by using BIODAC instead of cork, while still retaining the flexibility needed in polishing applications.

EXAMPLE 3

BIODAC IN PHENOLIC RESIN BONDED ABRASIVES FOR GRINDING APPLICATIONS

A curable phenolic resin composition comprising the following ingredients was prepared by admixing:

| % WT | |
|---|---|
| 73.3 | ABRASIVE GRAIN (ALUMINUM OXIDE, SILICON CARBIDE) |
| 12.1 | POWDERED PHENOLIC RESIN |
| 3.0 | LIQUID PHENOLIC RESIN |
| 11.6 | BIODAC |

A second curable phenolic resin composition of the same formulation except substituting bubbled alumina for BIODAC on a V/V basis was similarly prepared. The physical properties of the compositions, utilizing BIODAC as a grain replacement/substitute versus that same composition using bubbled alumina for the same function were evaluated. The results are set forth in Table 3.

TABLE 3

| | BIODAC | BUBBLED ALUMINA |
|---|---|---|
| FLEXURAL STRENGTH (psi) | 3748 | 3892 |
| ELASTIC MODULUS (KN/sqmm) | 12.17 | 16.05 |
| DENSITY (g/cc) | 1.721 | 1.798 |

The data illustrate that by using BIODAC in place of bubbled alumina a more flexible (less rigid) abrasive can be achieved without sacrificing strength. Bubbled alumina is an abrasive material capable of scratching the workpiece which in some applications may be undesirable due to surface finish requirements. In contrast, BIODAC (being a cellulose material) behaves much like cork in that it has a burnishing or polishing effect and in most cases improves surface finish. BIODAC is also superior to cork in resin bonded abrasives because it does not "spring back" after being compressed as does cork, disturbing the matrix of the abrasive and rendering it unusable.

What is claimed is:

1. An abrasive bond comprising a binder, abrasive grain, and a particulate grain-spacer comprising interlocked and bonded plant fibers.

2. The bond of claim 1, wherein the binder is a cured synthetic resin or cement.

3. The bond of claim 2, wherein the binder is an epoxy or phenolic resin.

4. The bond of claim 2, wherein the binder is magnesium oxychloride cement.

5. The bond of claim 1, wherein the particulate grain-spacer comprises interlocked and bonded plant fibers obtained by dewatering an aqueous slurry of plant fibers, followed by comminuting the fibers, agglomerating the comminuted fibers into particles, and drying the particles.

6. The bond of claim 1, wherein the particulate grain-spacer further includes an inorganic filler admixed with the fibers.

7. An abrasive tool comprising the abrasive bond of claim 1.

8. The abrasive tool of claim 7, wherein the binder is a cured synthetic resin or cement.

9. The abrasive tool of claim 8, wherein the binder is an epoxy or phenolic resin.

10. The abrasive tool of claim 8, wherein the binder is magnesium oxychloride cement.

11. The abrasive tool of claim 7, wherein the particulate grain-spacer comprises interlocked and bonded plant fibers obtained by dewatering an aqueous slurry of plant fibers, followed by comminuting the fibers, agglomerating the comminuted fibers into particles, and drying the particles.

12. The abrasive tool of claim 7, wherein the particulate grain-spacer further includes an inorganic filler admixed with the fibers.

13. The abrasive tool of claim 7, wherein said tool is a grinding wheel.

* * * * *